US005422803A

United States Patent [19]

Kilgore

[11] Patent Number: 5,422,803

[45] Date of Patent: Jun. 6, 1995

[54] CANDOLIER HOLDER

[75] Inventor: Karen P. Kilgore, Lubbock, Tex.

[73] Assignee: Gary Products Group, Inc., Lubbock, Tex.

[21] Appl. No.: 277,604

[22] Filed: Jul. 20, 1994

[51] Int. Cl.[6] ..... F21V 35/00

[52] U.S. Cl. ..... 362/392; 362/810; 362/397; 248/205.5

[58] Field of Search ..... 362/392, 393, 397, 161, 362/810; 248/311.2, 316.2, 205.5

[56] References Cited

U.S. PATENT DOCUMENTS

| | | | |
|---|---|---|---|
| 244,045 | 7/1881 | Geddes | 362/161 |
| 840,618 | 1/1907 | Golombek . | |
| 2,015,928 | 10/1935 | Goldstein | 362/397 |
| 2,117,884 | 5/1938 | Hapman | 248/205.5 |
| 2,139,805 | 12/1938 | Chase | 73/378 |
| 2,505,365 | 4/1950 | Roberts, Jr. | 177/329 |
| 2,806,314 | 9/1957 | Moran | 248/205.5 |
| 3,316,040 | 4/1967 | McGann | 248/311.2 |
| 4,392,191 | 7/1983 | White, Sr. | 362/392 |
| 4,468,721 | 8/1984 | Vandrilla | 362/392 |
| 4,839,784 | 6/1989 | Lin | 362/393 |
| 5,028,026 | 7/1991 | Philipps et al. | 248/206.2 |
| 5,110,078 | 5/1992 | Gary | 248/206.2 |
| 5,191,679 | 3/1993 | Harper | 248/311.2 |
| 5,199,781 | 4/1993 | Sweeny | 362/145 |

OTHER PUBLICATIONS

Brochure, *Safety Candle Holders,* 1993 Adams Mfg. Corp. (2 pages).

*Primary Examiner*—Ira S. Lazarus
*Assistant Examiner*—Sara Sachie Raab
*Attorney, Agent, or Firm*—Ross, Clapp, Korn & Montgomery

[57] ABSTRACT

A candolier holder, preferably made of molded plastic, having cooperatively engageable frame, lateral support and suction cup members, the frame member desirably having a hinged, outwardly foldable, unitarily molded base support member, and bosses adapted to retain the base support member in its outwardly folded position.

4 Claims, 4 Drawing Sheets

CANDOLIER HOLDER

BACKGROUND OF THE INVENTION

1. Field of the Invention

This invention relates to a device for supporting candoliers, and more particularly, to a molded plastic device for supporting a candolier in a window or on or beside another inclined, preferably vertical, smooth surface such as, for example, a mirror.

2. Description of Related Art

As used herein, the term "candolier" generally refers to lightweight electric candles of the type frequently used for decorative lighting, especially holiday lighting, in windows. Such candoliers are frequently made of molded plastic and comprise a base member, at least one tubular or tapered tubular upright member having a threaded socket at the end opposite the base member. The threaded socket is adapted to engage the threaded socket of an electric light bulb, and typically receives electrical current through a conductor extending through the base and tubular member. Alternatively, one or more batteries disposed inside the base or tubular member can supply electrical energy to the socket and bulb.

Because candoliers are usually lightweight and because the windowsills in which they are often displayed are narrow, the weight of a conventional electrical cord extending out of the base and hanging over the windowsill can cause the candolier to turn over or fall out of the window. In an effort to overcome these difficulties, holding devices for electric candles have previously been disclosed, for example, in U.S. Pat. Nos. 4,392,191; 4,468,721; and 5,199,781. Other support members for electric candles are disclosed, for example, in U.S. Pat. Nos. 2,505,365 and 4,839,784. Devices utilizing suction cups as mounting devices for support members are disclosed, for example, in U.S. Pat. Nos. 840,618; 2,139,805; 5,028,026; and 5,110,078.

SUMMARY OF THE INVENTION

According to one embodiment of the invention disclosed herein, a candolier holder is provided that comprises easily attachable and detachable means for supporting a candolier on a windowsill, in a window, or beside another smooth support surface such as a mirror.

According to a preferred embodiment of the invention, a molded plastic candolier holder is provided that comprises an elongated frame member, a base support member connected to the frame member, a suction cup member attached to the frame member at a position spaced away from the base support member, and a lateral support member adapted to maintain the longitudinal axis of a candolier in substantially parallel alignment with the frame member.

According to one particularly preferred embodiment of the invention, a foldable hinge member is provided for connecting the base support member to the frame member, and retainer means are provided for selectively maintaining the base support member in a predetermined angular relation to the frame member.

According to another particularly preferred embodiment of the invention, the suction cup member engages the frame member and the lateral support member engages the suction cup member.

According to another particularly preferred embodiment of the invention, the base support member comprises a plurality of perpendicularly extending, spaced-apart projections for alternately maintaining candolier base members of differing sizes in a preferred positional relationship to the frame member.

BRIEF DESCRIPTION OF THE DRAWINGS

The apparatus of the invention is further described and explained in relation to the following figures of the drawings wherein.

Like reference numerals are used to indicate like parts in all figures of the drawings.

DESCRIPTION OF THE PREFERRED EMBODIMENTS

Figure 2:
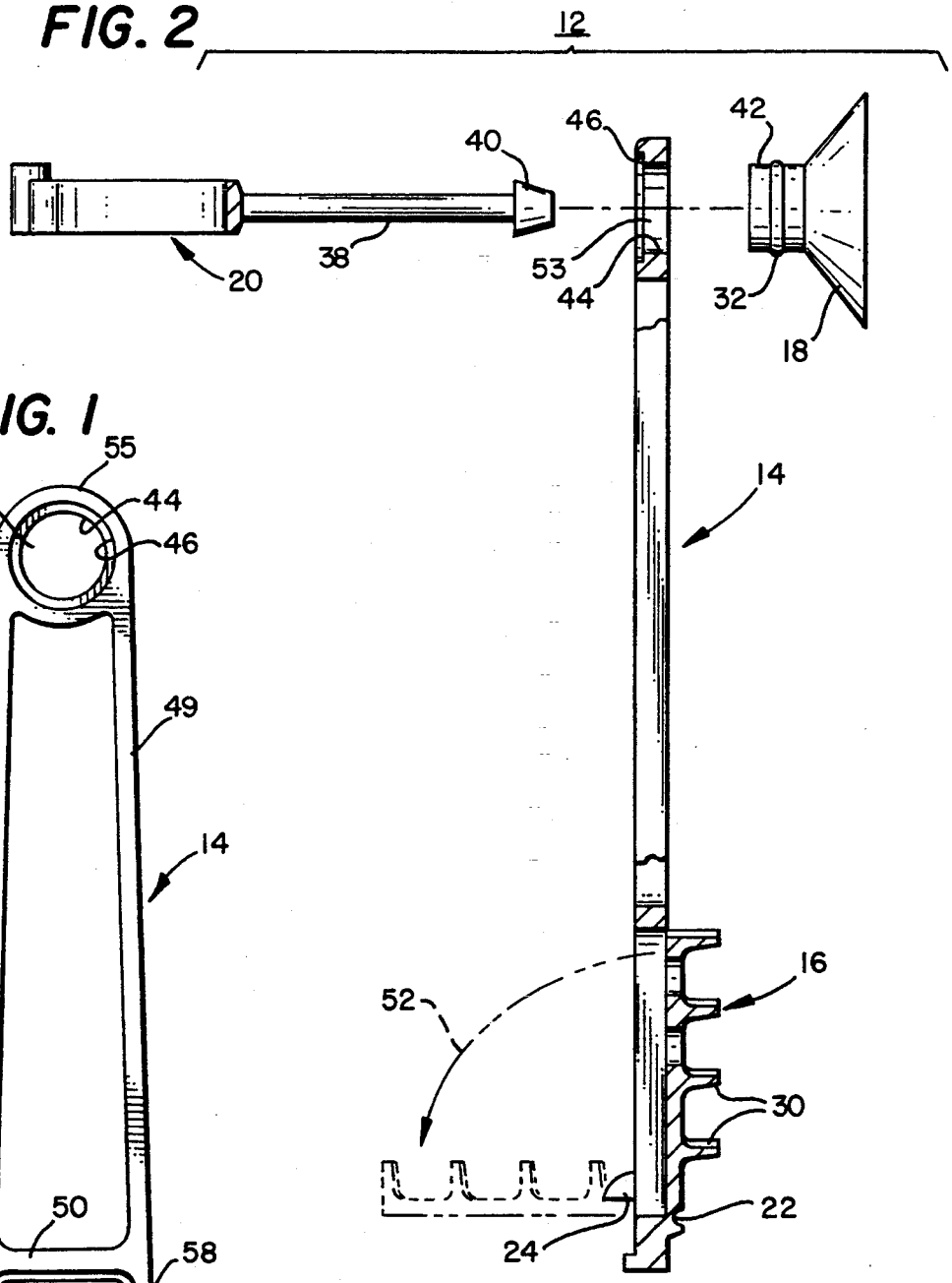
FIG. 2 is an exploded side elevation view, partially in section, of a preferred embodiment of the candolier holder of the invention.

Referring to FIG. 2, candolier holder 12 of the invention preferably comprises frame member 14, base support member 16, suction cup member 18 and lateral support member 20. Frame member 14, suction cup member 18 and lateral support member 20 are preferably separately molded, and as shown in FIG. 2, are not yet assembled to form candolier holder 12. A preferred material for use in making frame member 14 and lateral support member 20 is a moldable thermoplastic such as polypropylene. A preferred material for use in making suction cup member 18 is a moldable thermoplastic such as a flexible polyvinyl chloride resin. It will be understood of course by those of ordinary skill in the art upon reading this disclosure that other plastics and modified plastics can also be used to make the structures disclosed herein within the scope of the present invention.

Figure 1:
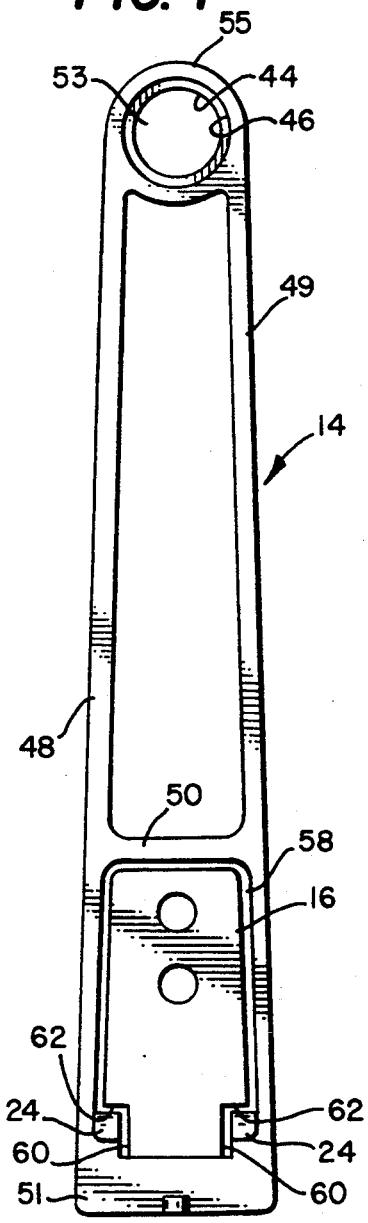
FIG. 1 is a front elevation view of a preferred embodiment of the frame member of the candolier holder of the invention.
Figure 3:
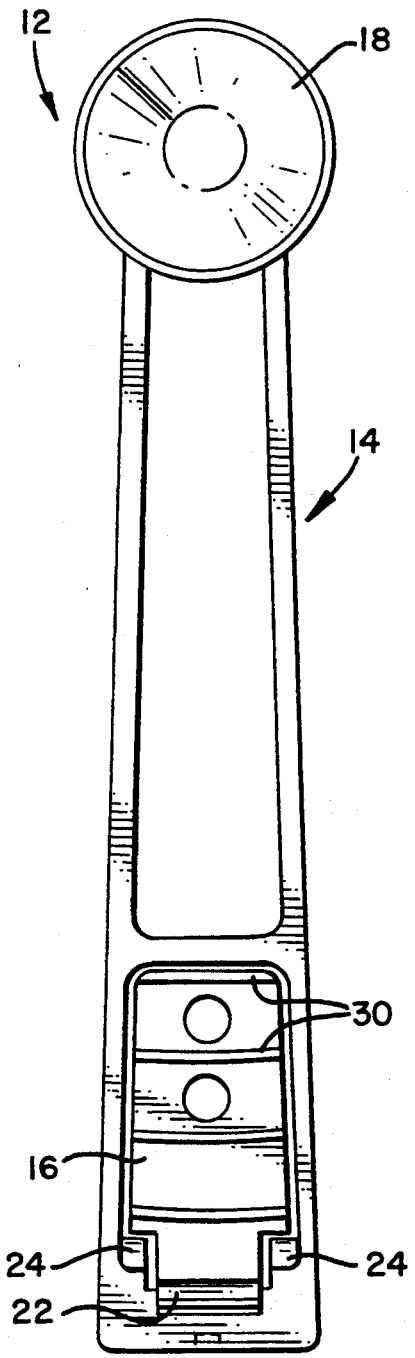
FIG. 3 is a rear elevation view of a preferred embodiment of the candolier holder of the invention.
Figure 4:
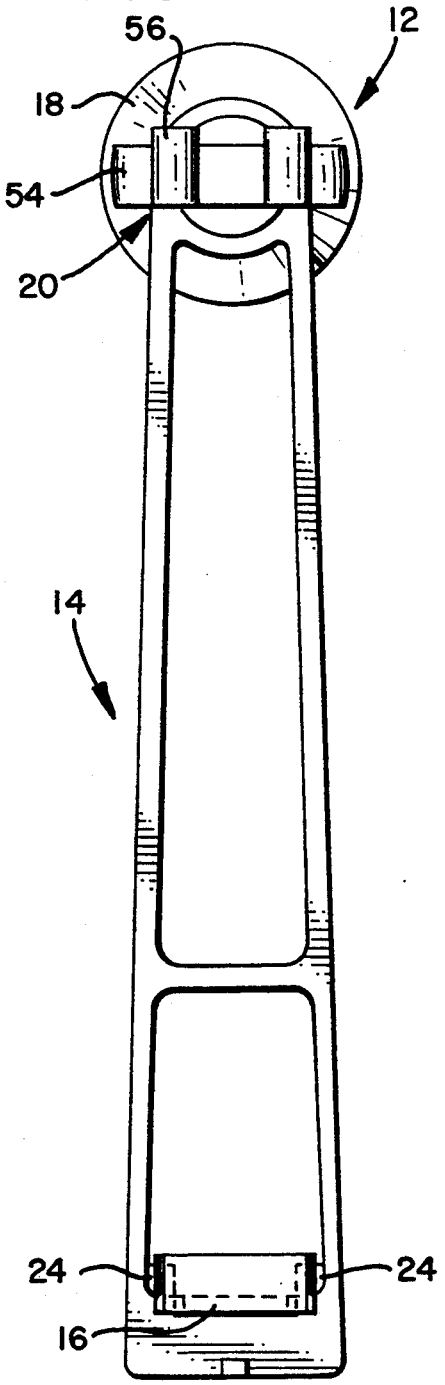
FIG. 4 is a front elevation view of the candolier holder of FIGS. 2 and 3 with the base support member in the position that is shown in phantom outline in FIG. 2.
Figure 5:
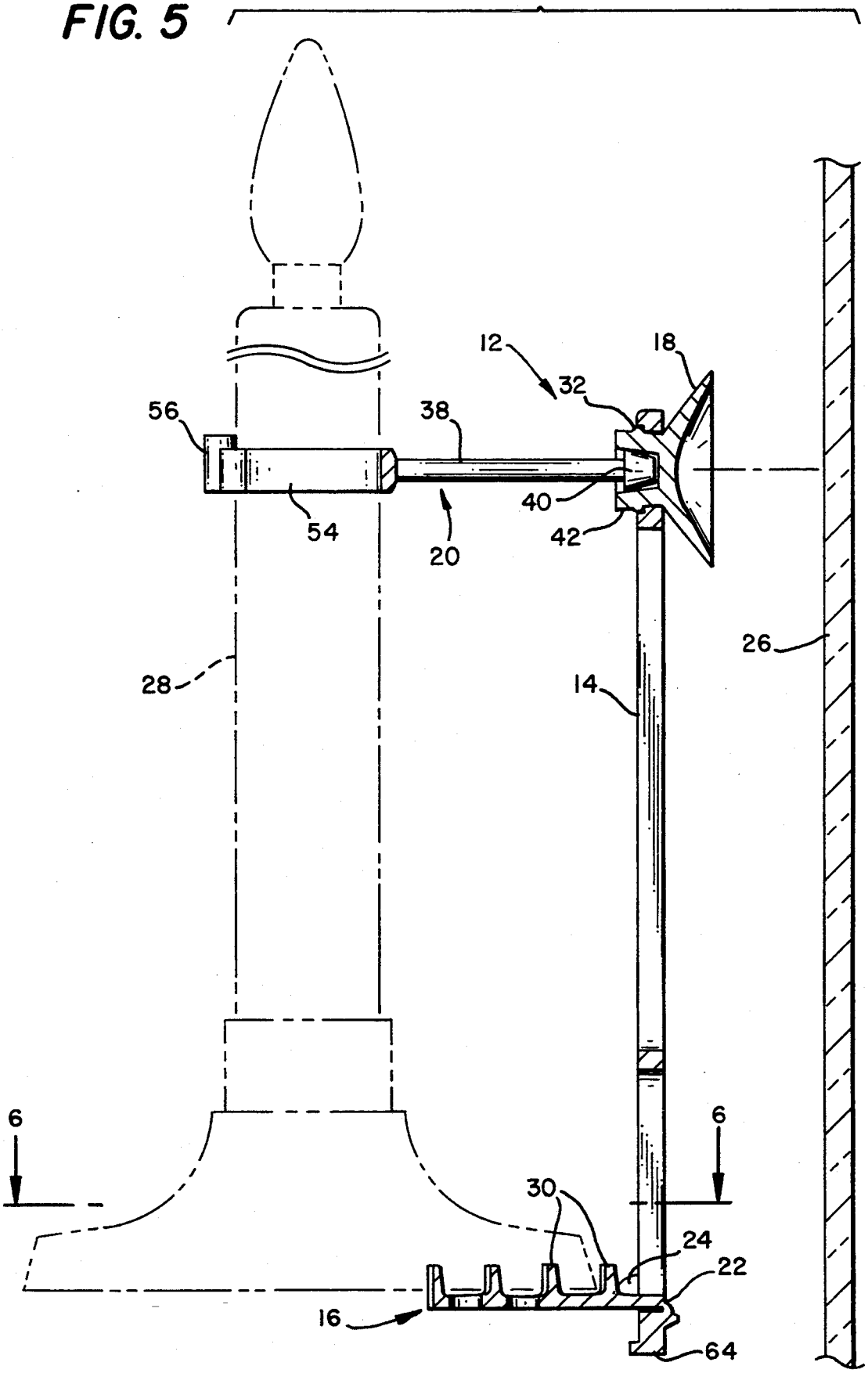
FIG. 5 is a side elevation view, partially in section, of the candolier holder of FIGS. 2–4 in proximity to a support surface and showing in phantom outline a candolier supported by the candolier holder.
Figure 6:
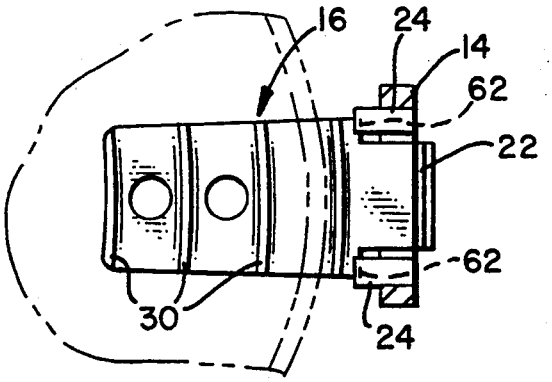
FIG. 6 is a detail plan view, partially in section, of the frame member and base support member of a preferred candolier holder of the invention, with a segment of a candolier base member shown in phantom outline in relation to the base support member, taken along line 6—6 of FIG. 5.

The structure of a preferred embodiment of frame member 14 is further described and explained in relation to FIGS. 1 and 2. Referring to FIG. 1, frame member 14 preferably comprises unitarily molded, elongate side members 48, 49 interconnected by transverse members 50, 51 and arcuate end section 55. Arcuate end section 55 preferably further comprises opening 53 bounded by side wall 44 and recess 46, also seen in FIG. 2. According to this preferred embodiment of the invention, base support member 16 is molded inside space 58 between transverse members 50, 51 and is connected to transverse member 51 by hinge member 22, as shown in FIGS. 2, 3, 5 and 6. Bosses 24, visible in FIGS. 1–6, desirably cooperate with recesses 60 (FIG. 1) of base support member 16 to permit base support member 16 to be folded outwardly as shown by arrow 52 in FIG. 2 for use of candolier holder 12 and also function as retainer means to maintain base support member 16 in the outwardly folded position by frictionally engaging shoulders 62 as shown in FIGS. 5 and 6. As seen in FIG. 2, bosses 24 desirably have a curved surface on one side to assist shoulders 62 in sliding over bosses 24 as base support member 16 is rotated outwardly, and a flat surface on the other side to retain base support member in the folded position after shoulders 62 have snapped over bosses 24. Projections 30 are desirably provided on base support member 16 and are oriented so as to be upwardly directed whenever base support member is folded at hinge 22 to the position shown in FIG. 5. Projections 30 are preferably substantially parallel and spaced apart to accommodate candoliers 28 having different sized base portions, and help maintain candolier 28 in a preferred (generally, parallel) alignment to frame member 14.

Figure 7:
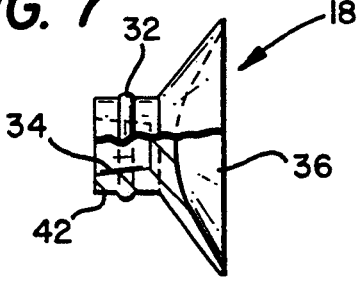
FIG. 7 is a detail side elevation view of a preferred suction cup member for use in the candolier holder of the invention.

Referring to FIG. 7, suction cup member 18 preferably comprises a cup portion 26 and a neck portion 42. Neck portion 42 preferably further comprises circumferentially extending, outwardly facing projection 32 and tapered recess 34. Referring to FIGS. 2, 5 and 7, suction cup member 18 is desirably frictionally connected to frame member 14 of candolier holder 12 by inserting neck portion 42 into opening 53 until projection 32 snaps into recess 46.

Figure 8:
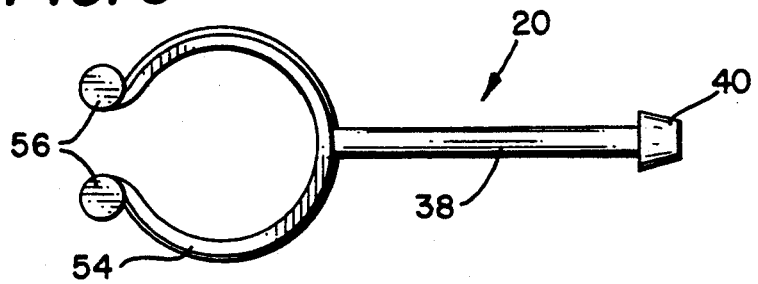
FIG. 8 is a detail plan view of a preferred lateral support member for use in the candolier holder of the invention.
Figure 9:
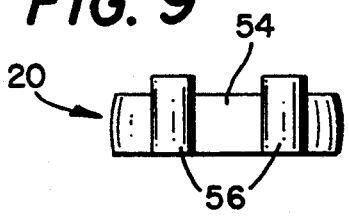
FIG. 9 is a front elevation view of the lateral support member of FIG. 8.
Figure 10:
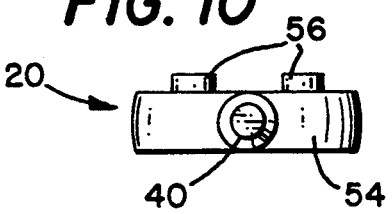
FIG. 10 is a rear elevation view of the lateral support member of FIGS. 8 and 9.

Referring to FIGS. 8–10, lateral support member 20 of candolier holder 12 preferably comprises rod section 38 having plug member 40 at one end thereof and clip member 54 at the other end. Referring to FIGS. 2, 5 and 7, lateral support member 20 is preferably connected to suction cup member 18 and to frame member 14 by inserting plug member 40 into tapered recess 34 of suction cup member 18 after neck 42 of suction cup member 18 has been inserted into opening 53 of frame member 14 as discussed above. When attachment of lateral support member 20 to frame member 14 is accomplished in this manner, plug member 40 and recess 34 are cooperatively sized to provide snug frictional engagement therebetween when assembled as depicted in FIG. 5. Cylindrical posts 56 are preferably provided at the ends of clip member 54 to facilitate sliding candolier 28 therebetween.

Referring to FIG. 5, candolier 28 is desirably supported in a preferred position against smooth surface 26 by assembling frame member 14, suction cup member 18 and lateral support member 20 of candolier holder 12 as shown and as described above, by positioning candolier 28 in the position shown relative to candolier holder 12, and by pressing suction cup member 18 against smooth surface 26 to cause suction cup member 18 to adhere to smooth surface 26. If candolier 28 is to be supported in a window, bottom edge 64 of frame member 14 can be rested on a windowsill if desired to provide additional support.

Other alterations and modifications of the invention will likewise become apparent to those of ordinary skill in the art upon reading the present disclosure, and it is intended that the scope of the invention disclosed herein be limited only by the broadest interpretation of the appended claims to which the inventor is legally entitled.

I claim:

1. A candolier holder comprising a molded plastic frame member, a suction cup member and a lateral support member, the frame member further comprising an outwardly foldable base support member connected to the frame member by a hinge, and the lateral support member comprising a clip member having means for frictionally engaging a candolier; the suction cup member comprising means for frictionally engaging the frame member; and the lateral support member comprising means for frictionally engaging the suction cup member.

2. The candolier holder of claim 1 wherein the frame member has a circular opening near one end thereof and wherein the suction cup member comprises a neck portion adapted to frictionally engage the opening.

3. The candolier holder of claim 1 wherein the suction cup member comprises a neck portion having a recess therein, and wherein the lateral support member comprises a plug member adapted to frictionally engage the recess.

4. The candolier holder of claim 1 wherein the outwardly foldable base support member further comprises a plurality of spaced apart, perpendicularly extending projections substantially parallel to the hinge.

* * * * *